United States Patent [19]

Lee et al.

[11] Patent Number: 4,920,009

[45] Date of Patent: Apr. 24, 1990

[54] METHOD FOR PRODUCING LAMINATED BODIES COMPRISING AN RE-FE-B TYPE MAGNETIC LAYER AND A METAL BACKING LAYER

[75] Inventors: Robert W. Lee, Troy; Earl G. Brewer, Warren, both of Mich.

[73] Assignee: General Motors Corporation, Detroit, Mich.

[21] Appl. No.: 233,699

[22] Filed: Aug. 5, 1988

[51] Int. Cl.[5] ..... B22F 3/00

[52] U.S. Cl. ..... 428/552; 419/8; 419/10; 419/12; 419/28; 419/29; 428/900; 252/62.51; 252/62.55

[58] Field of Search ..... 419/8, 10, 12, 28, 29; 428/552, 900; 252/62.51, 62.55

[56] References Cited

U.S. PATENT DOCUMENTS

| | | | |
|---|---|---|---|
| 4,076,561 | 2/1978 | Lee et al. | 148/103 |
| 4,104,787 | 8/1978 | Jandeska et al. | 419/8 |
| 4,322,257 | 3/1982 | Menth | 419/41 |
| 4,325,757 | 4/1982 | Jandesk et al. | 419/8 |
| 4,710,239 | 12/1987 | Lee et al. | 419/12 |
| 4,792,367 | 12/1988 | Lee | 419/12 |
| 4,793,874 | 12/1988 | Mizoguchi et al. | 419/12 |
| 4,808,224 | 2/1989 | Chatterjee et al. | 75/246 |

FOREIGN PATENT DOCUMENTS 0133758 3/1985 European Pat. Off. .

*Primary Examiner*—Stephen J. Lechert, Jr.
*Attorney, Agent, or Firm*—George A. Grove

[57] ABSTRACT

Magnetically isotropic, fine grain, $RE_2Fe_4B$ phase containing particulate material is hot pressed to full density and bonded to a metal backing layer of desired shape and composition. Additionally, if desired, the fully dense isotropic material can be further deformed in a direction lateral to the press direction so as to strain the particles to align the preferred magnetic axes of the crystal grains therein and thus form a laminate of a magnetically anisotropic magnet layer bonded to a metal backing layer.

20 Claims, 3 Drawing Sheets

METHOD FOR PRODUCING LAMINATED BODIES COMPRISING AN RE-FE-B TYPE MAGNETIC LAYER AND A METAL BACKING LAYER

This invention relates to a method for hot working magnetically isotropic powder particles of finely crystalline alloys containing one or more light rare earth (RE) elements, one or more transition metals (TM) and boron with an Nd-Fe-B type intermetallic phase so as to cause crystallites to be configured to produce resultant anisotropic powder particles which are bonded to a metal backing plate.

BACKGROUND OF THE INVENTION

Permanent magnet compositions based on the rare earth (RE) elements neodymium or praseodymium or both, the transition metal iron or mixtures of iron and cobalt, and boron are known. Preferred compositions contain a large proportion of an $RE_2TM_{14}B$ phase where TM is one or more transition metal elements including iron. A preferred method of processing such alloys involves rapidly solidifying molten alloy to achieve a substantially amorphous to very finely crystalline microstructure that has isotropic, permanently magnetic properties. In another preferred method, overquenched alloys without appreciable coercivity can be annealed at suitable temperatures to cause grain growth and thereby induce magnetic coercivity in a material having isotropic, permanently magnetic properties.

It is also known that particles of rapidly solidified RE-Fe-B based isotropic alloys can be hot pressed into a substantially fully densified body and that such body can be further hot worked and plastically deformed to make an excellent anisotropic permanent magnet. Thus, alloys with overquenched, substantially amorphous microstructures are worked and plastically deformed at elevated temperatures to cause grain growth and crystallite orientation which result in substantially higher energy products than in the best as-rapidly-solidified alloys.

As stated above, the preferred rare earth (RE)-transition metal (TM)-boron (B) permanent magnet composition consists predominantly of $RE_2TM_{14}B$ grains with an RE-containing minor phase(s) present as a layer at the grain boundaries. It is particularly preferred that on the average the $RE_2TM_{14}B$ grains be no larger than about 500 nm in the permanent magnet product.

While such hot working, e.g., die upsetting, produces individual magnets suitable for many purposes, in some applications it would be desirable to provide such a magnet with an integral, high strength metal backing plate. We perceive that such an assembly could be formed during hot work processing of the isotropic particles by employing a backing material to aid in the formation of anisotropic magnet bodies while simultaneously providing a bond between the anisotropic material layer and a high strength metal backing.

It is known to provide a metal backing for a rare earth metal-cobalt powder as shown in U.S. Pat. No. 4,076,561. However, the prior art does not disclose the use of a metal layer to aid in a desired crystallographic orientation of magnetically isotropic material with respect to a metal backing plate to produce a resultant anisotropic magnet body.

STATEMENT OF THE INVENTION AND ADVANTAGES

The present invention contemplates a method and apparatus for making metal-backed, permanent magnetically anisotropic material from isotropic material such as melt-spun ribbon particles of amorphous or finely crystalline material having grains of $RE_2TM_{14}B$ where RE is one or more rare earth elements including neodymium and/or praseodymium, TM is iron or iron-cobalt combinations and B is the element boron. Preferably, a major portion of the rare earth material is neodymium and/or praseodymium. The ribbon is fragmented, if necessary, into individual particles of such isotropic material. The individual particles can also be in ribbon powder form or can be ribbon fragments that are pre-hot pressed to a fully dense form.

A feature of the present invention is to provide a method wherein such $RE_2TM_{14}B$ magnetically isotropic material is either hot pressed against a one-piece backing or against particulate backing material to form a backed magnet of compressed $RE_2TM_{14}B$ magnetically isotropic material. In another feature of our invention, such isotropic material is both hot pressed and hot worked against a one-piece metal backing plate or against iron powder, steel powder or other suitable ferromagnetic or nonmagnetic powder so as to deform the magnetically isotropic material to align the crystal grain structure therein along a crystallographically preferred magnetic axis while fusing it to a solid metal plate or to the consolidated powder backing material.

A further feature of the method of the present invention is to provide a method of the type set forth in the preceding paragraphs wherein the magnetically isotropic material is heated and pressure-formed parallel to an interface with ferromagnetic powder material to enhance mechanical bonding therebetween while simultaneously causing desired crystallographic alignment for producing an anisotropic magnet body.

Yet another feature of the present invention is to form $RE_2TM_{14}B$ magnetically isotropic material against a nonmagnetic alloy, e.g. brass, backing material to produce a bonding reaction layer while simultaneously forming a solid compact of magnetically anisotropic material with a metal backing.

Still another feature of the present invention is to provide a magnet of magnetically anisotropic material of the $RE_2TM_{14}B$ type bonded to a higher strength metal plate.

In accordance with our invention, the aforesaid objects and features are obtained by loading a die with a metal backing material and a layer of particulate magnetically isotropic material having spherical grains of an average crystal grain size no greater than about 500 nm and having a tetragonal crystalline phase with an empirical formula $RE_2TM_{14}B$ wherein RE is a rear earth metal including neodymium or praseodymium, TM is a transition metal taken from the group consisting of iron and mixtures of iron and cobalt, and B is boron; the preloaded material is then hot pressed so as to consolidate the isotropic material into a fully dense magnetic layer against the metal backing material and to bond together the layers. In another embodiment, the magnetic layer is further hot deformed and magnetically aligned against the metal backing material to form a resultant magnetic layer of magnetically anisotropic material bonded to a layer of metal backing material.

The loading step can include placing particles of the magnetically isotropic material on one surface of a steel plate (e.g.) and pressing the isotropic material under pressure and at an elevated temperature against the surface of a metal, e.g. steel, backing plate so as to simultaneously densify the particles of the $RE_2TM_{14}B$ material in a unitary layer of magnetic material while simultaneously bonding the magnetic material to the supportive backing plate. Optionally, the magnetic layer can be hot worked along the surface of the backing plate to align the axes of easy magnetization of the grains such that the resultant product comprises a magnetically anisotropic layer backed with another desired metal layer.

Alternatively, the particulate isotropic material can be pressed between plates of steel; can be loaded into steel or copper tubes and hot worked with respect to the walls of the tube; can be loaded into a hot press die with a metal backing of powdered iron, steel or other ferromagnetic powder material and pressed at an elevated temperature against the metal backing material to cause bonding therebetween to form a layer of fully dense, magnetically isotropic material bonded to the metal backing material so as to form a protective metal cladding on such treated material.

As previously stated, the magnetically isotropic material can initially be either amorphous or finely crystalline material having grains of $RE_2TM_{14}B$ as described. The isotropic starting material can be formed by rapid solidification including but not limited to melt-spun ribbon material and rapidly chill cast ingot material. In the case of ribbon particles, the method of the present invention can include use of a starting material of ribbon particles which are prepressed under temperature conditions to produce a fully dense, isotropic magnetic body with a supportive metal backing. The fully dense isotropic material can also be subsequently hot worked to form an anisotropic magnetic body with a supportive metal backing.

In all cases, the method of the present invention produces a metal clad, partially magnetically aligned material for use in magnet body applications.

BRIEF SUMMARY OF THE INVENTION

Our method is applicable to magnetic compositions comprising a suitable transition metal component, a suitable rare earth component and boron.

The transition metal component is iron or iron and (one or more of) cobalt, nickel, chromium or manganese. Cobalt is interchangeable with iron up to about 40 atomic percent. Chromium, manganese and nickel are interchangeable in lower amounts, preferably less than about 10 atomic percent. Zirconium and/or titanium in small amounts (up to about 2 atomic percent of the iron) can be substituted for iron. Very small amounts of carbon and silicon can be tolerated where low carbon steel is the source of iron for the composition. The composition preferably comprises about 50 atomic percent to about 90 atomic percent transition metal component—largely iron.

The composition also comprises from about 10 atomic percent to about 50 atomic percent rare earth component. Neodymium and/or praseodymium are the essential rare earth constituents. As indicated, they may be used interchangeably. Relatively small amounts of other rare earth element, such as samarium, lanthanum, cerium, terbium and dysprosium, may be mixed with neodymium and praseodymium without substantial loss of the desirable magnetic properties. Preferably, they make up no more than about 40 atomic percent of the total rare earth component. It is expected that there will be small amounts of impurity elements with the rare earth component.

The composition contains at least 1 atomic percent boron and preferably about 1 to 10 atomic percent boron.

The overall composition may be expressed in the general formula $RE_{1-x}(TM_{1-y}B_y)_x$. The rare earth (RE) component makes up 10 to 50 atomic percent of the composition ($x=0.5$ to 0.9), with preferably at least 60 atomic percent of the rare earth component being neodymium and/or praseodymium. The transition metal (TM) as used herein makes up about 50 to 90 atomic percent of the overall composition, with iron preferably representing at least about 60 to 80 atomic percent of the transition metal content. The other constituents, such as cobalt, nickel, chromium or manganese, are called "transition metals" insofar as the above empirical formula is concerned.

Boron is preferably present in an amount of about 1 to 10 atomic percent ($y=0.01$ to 0.11) of the total composition.

The practice of our invention is applicable to a family of iron-neodymium and/or praseodymium-boron containing compositions which are further characterized by the presence or formation of the tetragonal crystal phase specified above, illustrated by the atomic formula $RE_2TM_{14}B$, as the predominant constituent of the material. In other words, the hot worked permanent magnet product contains at least fifty percent by weight of this tetragonal phase. Here RE means, principally, Nd or Pr, and the easy magnetizing direction is parallel to the "C" axis of the tetragonal crystal. The suitable composition also contains at least one additional phase, typically a minor phase at the grain boundaries of the $RE_2TM_{14}B$ phase. The minor phase also contains the rare earth constituent and is richer in content of such constituent than the major phase.

For convenience, the compositions have been expressed in terms of atomic proportions. Obviously these specifications can be readily converted to weight proportions for preparing the composition mixtures.

For purposes of illustration, our invention will be described using compositions of approximately the following proportions: $Nd_{0.13}(Fe_{0.95}B_{0.05})_{0.87}$. However, it is to be understood that our method is applicable to a family of compositions as described above.

In one example, such compositions are melted to form alloy ingots. The ingots are remelted and rapidly solidified, e.g., melt spun, i.e., discharged, through a nozzle having a small diameter outlet onto a rotating chill surface. The molten metal alloy is thus solidified almost instantaneously and comes off the rotating surface in the form of small ribbon-like particles.

The resultant product may be amorphous or it may be a very finely crystalline material. If the material is crystalline, it contains the $Nd_2Fe_{14}B$ type intermetallic phase which has high magnetic symmetry. The quenched material is magnetically isotropic as formed.

Depending on the rate of cooling, molten transition metal-rare earth-boron compositions can be solidified to have a wide range of microstructures. Thus far, however, melt-spun materials with grain sizes greater than several microns do not yield preferred permanent magnet properties. Fine grain microstructures, where the crystal grains have an average size in the range of about 20 to 500 nanometers, have coercivity and other useful permanent magnet properties. Amorphous materials do not. However, some of the glass microstructure materials can be appealed to convert them to fine grain permanent magnets having isotropic magnetic properties. Our invention is applicable to such overquenched, glassy materials. It is also applicable to "as-quenched" high coercivity, fine grain materials. Care must be taken to avoid excessive time at high temperature to avoid coercivity loss associated with excessive grain growth.

On the specific case of melt-spun ribbon material, our inventive process includes the steps of fragmenting the melt-spun ribbon material into coarse powder particles with the greatest dimensions less than 250 μm and smallest dimension greater than 60 μm as obtained from American Standard Mesh sizes of 325×60. Such powder particles will hereafter be referred to as "coarse powder particles", with it being understood that other particle/powder forms of magnetically isotropic starting material of the $RE_2TM_{14}B$ type are also referenced when the term "coarse powder particle" is used herein. Each such particle, of course, contains many, many $RE_2TM_{14}B$ crystal grains.

The process of the present invention in one embodiment directs hot working pressure on such isotropic starting material to cause crystallites therein to be compressed against a metal backing plate to form a fully dense, isotropic magnetic body with a supportive metal back. In another embodiment, the fully dense isotropic material is further laterally deformed with respect to the supportive metal backing by hot working to align the crystallographically preferred magnetic axes of the grains. The resultant metal layer backed, oriented material is magnetically anisotropic and can be used to form magnet products such as arcuates, permanent anisotropic magnets only a few millimeters thick but several square centimeters in area.

Several proposals have been suggested to hot work the individual powder particles to produce such preferred crystallographic alignment on a metal backing plate.

The present invention includes a process wherein the coarse powder particles are placed in a die with either a solid metal backing or with powdered ferromagnetic material. The coarse metal particles are then hot pressed against the metal backing to cause the individual coarse powder particles to be compressed with respect to the metal backing so as to produce a fully dense, magnetically isotropic magnetic body. The process can further incorporate the step of laterally deforming the fully dense, isotropic material with respect to the supportive metal layer to cause desired crystallographic alignment in the grain structure of the coarse metal particles so as to produce a magnetically anisotropic material backed by a supportive metal layer.

The backing metal is selected from material which will bond to the magnetically isotropic melt-spun fragments of $RE_2Fe_{14}B$ alloy during hot die upsetting. In one embodiment of the inventive method, the backing metal is a solid preformed material which is placed in the die for hot working with the isotropic coarse powder particles. The backing material is layered with the isotropic material. The isotropic material is treated by hot working against the ferromagnetic material. A resultant magnet body is produced having a metal backing bonded to an isotropic material layer.

In another embodiment of the inventive method, the backing metal is initially a powdered metal which is then pressed and consolidated during hot pressing to form a metal layer against which the hot worked, coarse powder particles are bonded.

In both embodiments of the inventive method, the fully dense, coarse powder particles of magnetically isotropic material can be further laterally deformed to form a layer of magnetically anisotropic material using suitable hot press temperatures, typically in the range of 700° C. to 800° C. Press time is usually from 2 to 5 minutes. Pressures are 5 to 20 KPSI. The time, pressure and temperature variables combine to orient crystallites without unacceptably reducing magnetic coercivity.

The aforesaid objects and advantages of our invention will be better understood from the succeeding detailed description of the invention and the accompanying drawings thereof.

DETAILED DESCRIPTION OF THE DRAWINGS

Figure 4A:
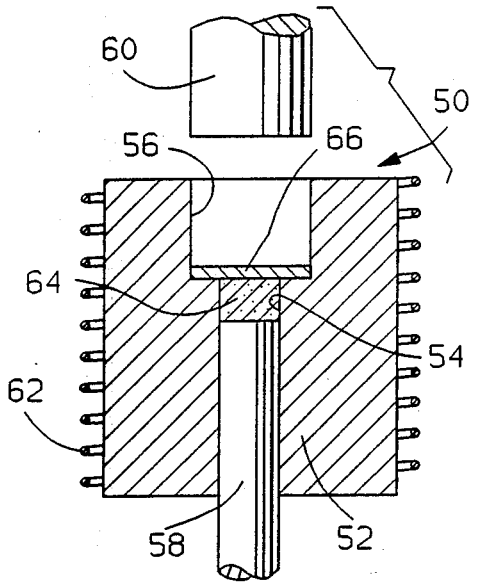
Figure 4B:
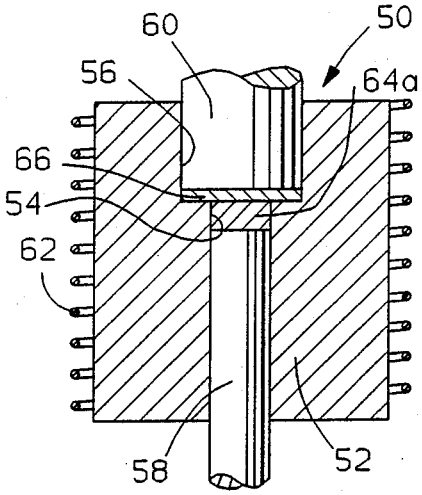
Figure 4C:
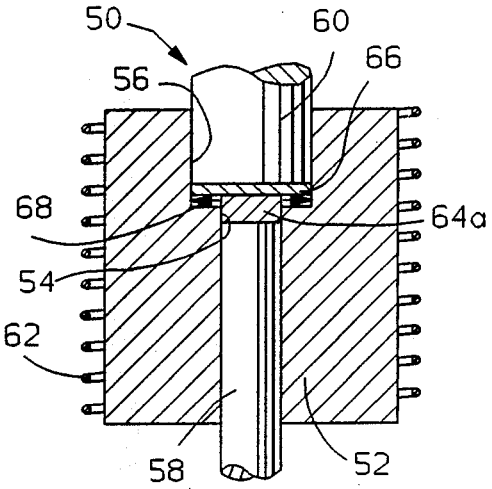
Figure 4D:
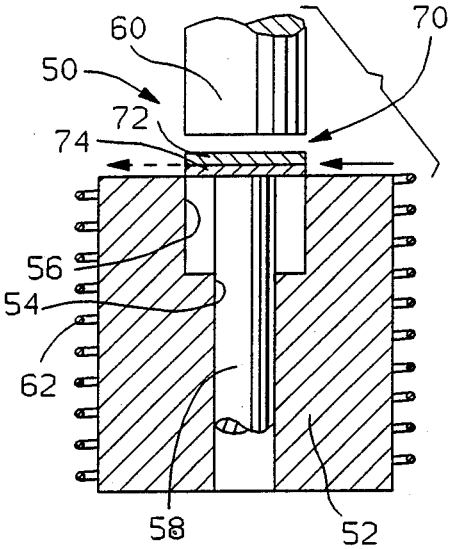
Figure 5A:
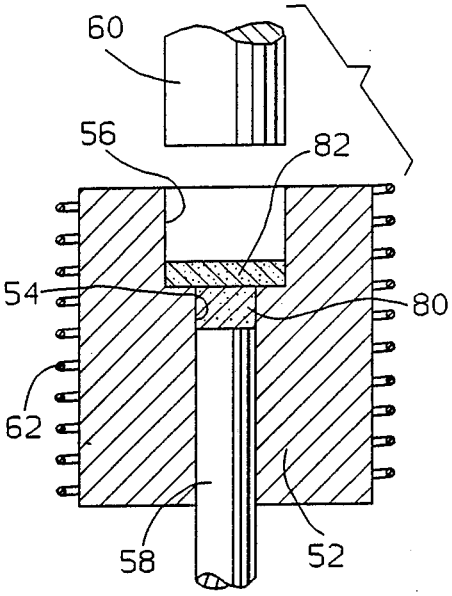
Figure 5B:
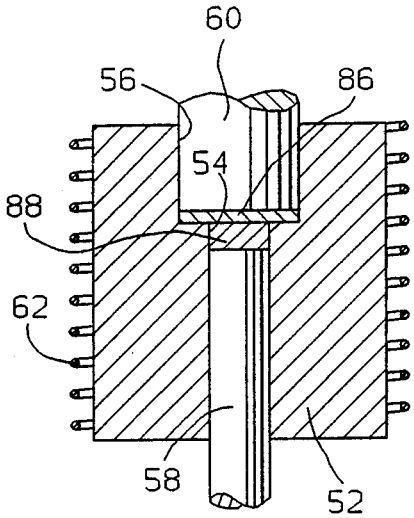

FIGS. 4*a*–4*d* are diagrammatic views of a process for forming metal-backed, anisotropic magnetic bodies; and FIGS. 5*a* and 5*b* are diagrammatic views of another embodiment of a process for forming such bodies.

DETAILED DESCRIPTION OF THE INVENTION

Figure 1:
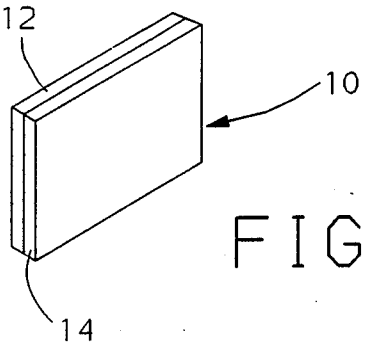
FIG. 1 is a perspective view of a magnet of metal clad, magnetically anisotropic material.

The inventive method of the present invention includes the following generalized steps:

1. Forming magnetically isotropic material;
2. Loading the isotropic material on a metal backing material;
3. Hot pressing the isotropic material against the metal backing material to simultaneously align, heat treat and bond the isotropic material to a metal cladding to form a magnetic body 10 as shown in FIG. 1. The magnetic body 10 has a supportive metal backing 12 and a layer 14 of hot pressed and, optionally, hot worked $RE_2TM_{14}B$ type composition.

The forming step of our invention is applicable to high coercivity, fine grain materials comprised of basically spherically shaped, randomly oriented $Nd_2Fe_{14}B$ grains with rare earth rich grain boundaries.

Figure 2:
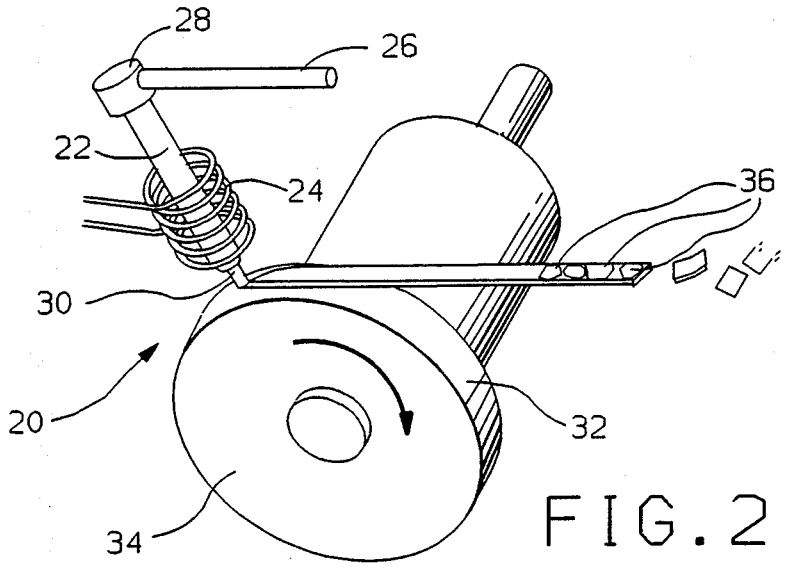
FIG. 2 is a diagrammatic view of apparatus for forming isotropic ribbon particles.

Suitable $RE_2TM_{14}B$ compositions can be made by melt spinning apparatus 20 as shown in FIG. 2. The Nd-Fe-B type starting material is contained in a suitable vessel, such as a quartz crucible 22. The composition is melted by an induction or resistance heater 24. The melt is pressurized by inert gas, such as argon, through duct 26. A small, circular ejection orifice about 500 microns in diameter (not seen in FIG. 2) is provided at the bottom of the crucible 22. A closure 28 is provided at the top of the crucible so that the argon can be pressurized to eject the melt from the vessel in a very fine stream 30.

The molten stream 30 is directed onto a moving chill surface 32 located about one-quarter inch below the ejection orifice. In examples described herein, the chill surface is a 25 cm diameter, 1.3 cm thick copper wheel 34. The circumferential surface is chrome plated. The wheel may be cooled if necessary. When the melt hits the turning wheel, it flattens, almost instantaneously solidifies and is thrown off as a ribbon or ribbon particles 36. The thickness of the ribbon particles 36 and the rate of cooling are largely determined by the circumferential speed of the wheel. In this work, the speed can be varied to produce a desired fine grained ribbon for practicing the present invention.

The cooling rate or speed of the chill wheel preferably is such that an amorphous or a fine crystal structure is produced which, on the average, has $RE_2TM_{14}B$ grains no greater than about 500 nm in dimension.

Figure 3:
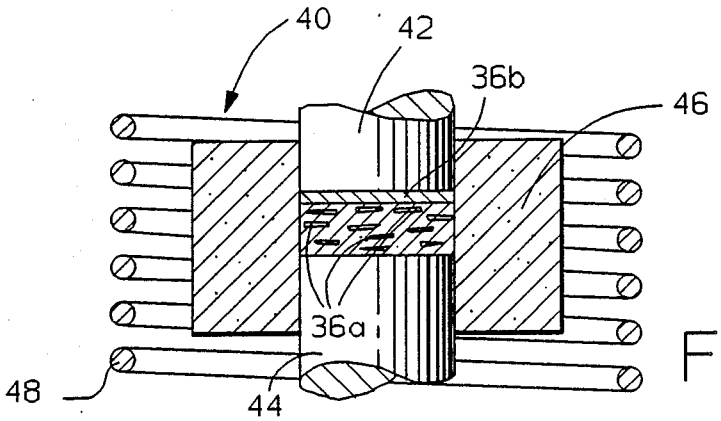
FIG. 3 is a diagrammatic view of apparatus for hot working magnetically isotropic ribbon particles.

FIG. 3 shows a hot press die apparatus 40 having tungsten carbide rams 42, 44 driven with respect to a graphite die 46 to compact and hot work preloaded, magnetically isotropic particulate material 36*a* and contains metal cladding or backing material 36*b* by the process of the present invention. An induction heater coil 48 inductively heats the die 46 in an inert gas to carry out a hot pressing operation which forms a resultant magnet product like that depicted in FIG. 1 with a metal cladding or backing layer fully densified and consolidated and a layer of substantially isotropic magnetic material.

The following examples further illustrate the invention.

Examples of the process of the present invention include loading a steel or other metal plate 36*b* in the die cylinder 46 after loading the die with a layer 36*a* of particulate magnetic material. The particulate material should be protected in a suitable nonoxidizing environment such as argon gas. The die is heated, e.g. by induction heating, and the rams 42, 44 are actuated to press the isotropic material against the metal cladding 36*b* to product a bonded interface therebetween. Times and pressures suitable to fully compress the isotropic material and to form it as a bonded layer of isotropic material of a metal cladding are in the range of 2 to 5 minutes at a temperature of 700° C. to 800° C. Suitable pressures are in the range of 5 to 20 KPSI. While one metal plate 36*b* is shown, the method also contemplates loading the particulate isotropic material in a hot upset die apparatus between spaced metal plates.

Furthermore, the particulate magnetically isotropic material can be bonded to a supportive metal layer by use of known hot isostatic pressing techniques.

FIGS. 4*a*–4*d* show a modified die apparatus 50 for processing particulate isotropic material so as to form a magnetically anisotropic magnet body with a supportive metal backing.

The apparatus 50 includes a die 52 with coaxially aligned bores 54, 56. The bores 54, 56 receive opposed punches or rams 58, 60. The bore 54 and ram 58 are of a lesser dimension than that of bore 56 and ram 60. The die 52 is heated by an induction heater coil 62 during a hot press operation in which the particulate material is protected in a suitable nonoxidizing environment such as argon gas.

FIG. 4*a* shows a first process step in which particulate isotropic material 64 is loaded into bore 54. A metal plate 66 is loaded into bore 56.

FIG. 4*b* shows a process step in which the particulate isotropic material 64 is heated and pressed against the metal plate 66 to bond a body 64*a* of fully dense, magnetically isotropic material on the metal plate 66 which serves as a protective metal backing.

In FIG. 4*c*, the rams 58 and 60 are raised to form a space 68 in bore 56. The body 64*a* is then laterally deformed to fill space 68. Such deformation produces alignment of magnetic axes of the crystallites in the body 64*a* as previously discussed.

In FIG. 4*d*, the ram 60 is removed from die 52 and the ram 58 is raised to release the two-layer magnet body 70 having a supportive metal backing 72 and a layer 74 of magnetically anisotropic $RE_2TM_{14}B$ material.

FIGS. 5*a* and 5*b* disclose another process wherein particulate isotropic material 80 is loaded in the small dimensioned bore of die apparatus which corresponds to the apparatus 50 in FIGS. 4*a*–4*d*. Then ferromagnetic or nonmagnetic powder material 82 is loaded in the large dimension bore. The die apparatus is heated and the powdered isotropic material 80 and powdered material 82 are compressed by the die rams as shown in FIG. 5*b*. The powder material 82, as compressed, forms a supportive metal layer 86 for a fully dense body 88 of magnetically isotropic material. If desired, further orientation of the crystallites in body 88 can be obtained by steps corresponding to those shown at FIGS. 4*c* and 4*d*.

Suitable metal backing material for the process of FIGS. 4*a*–4*d* include pure iron plate, SAE 1008 rimmed steel, SAE 1010 steel, Type 304 stainless, Type 430 stainless steel, brass or any other ferromagnetic or nonmagnetic material.

Suitable powder material for consolidation into a supportive metallic layer by the process of FIGS. 5*a* and 5*b* include iron powder, steel powder or other suitable ferromagnetic or nonmagnetic metallic powder.

In all cases, good bonds are formed at the interface between the supportive metal backing and the magnetic body of $RE_2Fe_{14}B$ material. This is the case whether the supportive metal backing is a solid metal plate or if it is a plate formed from consolidated metal powder. This is also the case whether the magnetic body is fully dense, magnetically isotropic $RE_2Fe_{14}B$ material or if the magnetic body is $RE_2Fe_{14}B$ material with crystallites oriented to define magnetically anisotropic material.

The interface between materials hot worked like those in FIGS. 4*a* and 4*b* but with a treated particle region pressed against a compacted powder region can have the interface formed perpendicular to the press direction as in FIG. 4*c*.

Cracks in an interface can be controlled by interspersing a more malleable material between a metal backing plate material and the layer of ribbon particles of isotropic material which is treated and bonded by our invention. Such malleable material is preferably in powder form and can be selected from the group of malleable metals, e.g. copper or brass. The malleable material can be layered between the isotropic starting material and the metal backing material prior to hot pressing as shown in FIG. 4*b*.

The metal backing can be a tooth segment of a brass gear. A treated ribbon powder region is bonded to the curved surface at a reaction layer of approximately one ribbon thickness (about 20 microns). The reaction layer is attributable to reaction between the Nd in the treated ribbon material and Zn in the brass material. A chill cast treated ingot material of $RE_2Fe_{14}B$ composition can be pressed and bonded to a metal backing such as a copper cylinder. In this case, the ingot material is hot pressed in a direction along the longitudinal axis of the containment cylinder.

Treated ribbon powder can be contained in a stainless steel cylinder and bonded thereto at an interface region. The isotropic starting material is hot pressed in a direction along the longitudinal axis of the cylinder.

Chill cast ingot material of $RE_2Fe_{14}B$ can be bonded to metal layers for forming a metal clad magnet body with a layer of anisotropic material. Such material can be hot pressed against a cold-rolled steel cylinder. The starting ingot material can be pressed along the cylinder axis to produce a treated material with a desired orientation of the crystallites therein.

INDUSTRIAL APPLICABILITY

The methods of the present invention are suitable for the mass production of permanent magnets from Nd-Fe-B alloy material whose principal magnetic phase is $Nd_2Fe_{14}B$. The process enables a variety of isotropic particles of such composition to be treated by hot press forming against various types of metal backings to produce a resultant magnet structure with a high strength metal cladding and a layer of magnetically anisotropic material. Such magnetically isotropic material can be bonded to a motor housing with or without magnet-receiving pockets by use of the process of the present invention. The metal backing can be either solid metal pieces or compacted powdered metal. The final pressed composite can be a body with desired magnetic properties for use in magnet body applications such as electrical motors. The backing material can serve both as a structural support and as a magnetic flux concentrator.

While representative embodiments of apparatus and processes of the present invention have been shown and discussed, those skilled in the art will recognize that various changes and modifications may be made within the scope and equivalency range of the present invention.

The embodiments of the invention in which an exclusive property or privilege is claimed are defined as follows:

1. A method of making a laminated magnetic article comprising a magnetic layer comprising iron, neodymium and/or praseodymium, and boron and a supportive metal layer bonded to the magnetic layer, said method comprising:

providing particulate material that is magnetically isotropic and characterized by a microstructure that is either amorphous material or of generally spherical crystal grains of an average size no greater than about 500 nm; and of a composition comprising a transition metal (TM) taken from the group consisting of iron and mixtures of iron and cobalt, one or more rare earth metals (RE) including neodymium and praseodymium, and boron, the proportions of such constituents being sufficient to form a product that upon crystallization consists essentially of the tetragonal crystalline compound having the empirical formula $RE_2TM_{14}B$;

hot pressing a layer of the particulate material against a layer of chemically compatable, different metal composition at a temperature and pressure to consolidate the particulate layer into a fully densified layer and to bond it to the metal backing to produce a resultant layer of magnetic material on a metallic backing.

2. In the method of claim 1, subsequently hot working the magnetic layer to deform it such that crystallographically preferred magnetic axes of grains therein are aligned so as to form a resultant magnetically anisotropic magnet body with a supportive backing plate.

3. In the method of claim 1, layering metallic backing powder and the isotropic particles and simultaneously pressing them during hot working to convert the metallic backing powder to a fully dense, sintered supportive backing plate bonded to a layer of fully dense, compressed, substantially isotropic magnetic material.

4. In the method of claim 3, subsequently hot working the consolidated isotropic material to deform it such that crystallographically preferred magnetic axes of grains therein are aligned so as to form a resultant magnetically anisotropic magnet body with a supportive backing plate.

5. In the method of claim 2, providing an expansion space, heating the compressed isotropic material and deforming it laterally into the expansion space to orient crystallites in the isotropic material while bonding the isotropic material metallic backing without removing the coercivity of the treated particles.

6. In the method of claim 1, providing a solid metallic backing with a reaction surface thereon, and loading the solid metal plate and the isotropic material in a hot press die prior to pressing the material against the reaction surface.

7. In the method of claim 6, subsequently hot working the compressed isotropic material to deform crystallites therein to be oriented along a crystallographically preferred magnetic axis to form a resultant magnetically anisotropic magnet body with a supportive backing plate.

8. In the method of claim 6, forming the metallic backing as a closed cylinder;

loading the closed cylinder with the magnetically isotropic particles by filling the cylinder therewith; and isostatically compressing the outer surface of the cylinder and hot working the particles to simultaneously bond a treated, magnetically anisotropic material layer to the metallic backing.

9. In the method of claim 6, forming the metallic backing as spaced solid plates, surrounding the spaced solid plates with the isotropic particles and applying heat and pressure thereto so as to hot work the isotropic particles against the spaced solid plates while simultaneously bonding treated particles to each of said solid plates.

10. In the method of claim 6, providing a metal cylinder to form a metallic backing, loading the cylinder with the isotropic particles and pressing the particles along the axis of the metal cylinder while hot working them thereagainst to form a bonded connection to the metallic backing.

11. A method for manufacturing magnetically anisotropic material from powder particles of magnetically isotropic material comprising $RE_2Fe_{14}B$ crystal grains with a rare earth-rich grain boundary structure comprising the steps of:

melt spinning a molten mixture of precursor material to form a ribbon of said magnetically isotropic material;

fragmenting the ribbon to form particles of magnetically isotropic material;

hot working the particles against a reaction surface of a metal backing to compress the isotropic particles together; and simultaneously bonding the coarse particles to the metal backing to form a composite magnet of isotropic material layer bonded to metal cladding.

12. In the method of claim 11, hot working the particles by placing the particles and a metallic backing in a hot working die and compressing the particles against the metal backing to bond the isotropic particles thereto.

13. In the method of claim 12, subsequently hot working the compressed particles to deform crystallites therein to be oriented along a crystallographically preferred magnetic axis to form a resultant magnetically anisotropic magnet body with a supportive backing plate.

14. In the method of claim 12, forming the metallic backing as powder, layering the metallic backing powder and the isotropic particles and simultaneously pressing them during hot working to convert the metallic backing powder to a fully dense sintered metal layer bonded to the isotropic particles.

15. In the method of claim 14, subsequently hot working the compressed particles to deform crystallites therein to be oriented along a crystallographically preferred magnetic axis to form a resultant magnetically anisotropic magnet body with a supportive backing plate.

16. In the method of claim 14, applying the hot working pressure on the magnetically isotropic particles in a direction parallel to the press direction so as to form an interface therebetween of a mechanically interlocked pattern.

17. A laminated magnetic article produced by the process of claim 1.

18. A laminated magnetic article produced by the process of claim 2.

19. A laminated magnetic article produced by the process of claim 11.

20. A laminated magnetic article produced by the process of claim 13.

* * * * *